US005592149A

United States Patent [19]

Alizi

[11] Patent Number: 5,592,149

[45] Date of Patent: Jan. 7, 1997

[54] SECURITY FENCE

[76] Inventor: Uri Alizi, 21 Haetzel St., Herzlia Pituach, Israel

[21] Appl. No.: 507,138

[22] Filed: Jul. 26, 1995

Related U.S. Application Data

[63] Continuation-in-part of Ser. No. 330,613, Oct. 28, 1994, abandoned, which is a continuation of Ser. No. 915,666, Jul. 21, 1992, abandoned.

[51] Int. Cl.[6] ..... G08B 13/00

[52] U.S. Cl. ..... 340/550; 250/227.14; 340/555; 385/13

[58] Field of Search ..... 340/541, 550, 340/555, 556, 668; 250/227.14, 227.15, 227.16; 385/13; 428/221, 224, 225, 245, 253, 255, 256, 257

[56] References Cited

U.S. PATENT DOCUMENTS

| | | | |
|---|---|---|---|
| 4,399,430 | 8/1983 | Kitchen | 340/550 |
| 4,558,308 | 12/1985 | Ciordinik et al. | 340/550 |
| 4,772,092 | 9/1988 | Hofèr et al. | 385/13 |
| 4,777,476 | 10/1988 | Dank . | |
| 5,049,855 | 9/1991 | Slemon et al. | 340/550 |
| 5,103,208 | 4/1992 | Riordan | 340/550 |
| 5,416,467 | 5/1995 | Ohta et al. | 340/555 |
| 5,434,557 | 7/1995 | alizi | 340/555 |
| 5,680,573 | 7/1987 | Ciordinik et al. | 340/551 |

FOREIGN PATENT DOCUMENTS

| | | | |
|---|---|---|---|
| 0049979 | 4/1982 | European Pat. Off. . | |
| 0308737 | 3/1989 | European Pat. Off. | 340/541 |
| 2039683 | 8/1980 | United Kingdom | 340/550 |

*Primary Examiner*—Thomas Mullen

*Attorney, Agent, or Firm*—Jacobson, Price, Holman & Stern, PLLC

[57] ABSTRACT

A security fence where in a frame there is provided a netting of a single continuous weft-knitted optical wire attached under tension to said frame, where one end of the wire is connected to a light source and the other to a light receiver. Any abrupt change in the intensity of the light passing through the optical wire actuates an alarm.

2 Claims, 2 Drawing Sheets

SECURITY FENCE

RELATED APPLICATIONS

The present application is a continuation-in-part of Ser. No. 08/330,613, filed Oct. 28, 1994, now abandoned, which is a continuation of Ser. No. 07/915,666, filed Jul. 21, 1992, now abandoned.

FIELD OF THE INVENTION

This invention relates to security fences embodying optical fibers, associated with optical transmitters and optical receivers, for signaling damages and stresses to the fence due to intrusion attempts.

BACKGROUND OF THE INVENTION

Many intrusion detection barriers based on the use of optical fibers have been described in the prior art. In one type of such barriers, a sensor wire comprising optical fibers is stretched horizontally under tension between posts and is connected at one to an optical transmitter and at the other end to an optical receiver. Any attempt to climb over the fence results in changes of tension and possibly in damage to the sensor wire, and therefore in a change in the intensity of the light transmitted through it, which is sensed by the optical receiver, and activates an alarm.

A security fence comprising optical fibers is described in U.S. Pat. No. 4,777,476. It comprises a multiplicity of hollow rigid bar elements and an optical fiber extending through some of the bar elements. Predetermined bending of the optical fiber is provided in response to bending of some of the rigid bar elements by a given amount. An optical fiber support is disposed within each of the bar elements containing the optical fiber and arranged so as not to be displaced in response to bending of the corresponding rigid bar element up to a given amount. Such a structure however requires the use of hollow rigid bars, is not adapted to standard fences and is suited only to special applications, and further, is highly expensive.

Another type of a known security fence, described in European Patent 49,979, a mesh structure is provided, comprising an upper and a lower horizontal wire and transverse wires attached to them and disposed at a slant, to cross one another. All the wires are made of or comprise optical fibers. The various optical fibers are connected at their jointing points by means of connecting members which prevent relative displacement of said fibers and are sufficiently positive to ensure damage to the optical fibers when a certain load is applied to the mesh. Each fiber is connected to an optical transmitter and an optical receiver, so that its rupture will cause interruption of light transmission between the two and activate an alarm. Such a wire fence requires a multiplicity of optical circuits, each consisting of an optical transmitter, an optical receiver, and the fiber connecting them, which constitutes a disadvantage. Furthermore, it does not provide full protection against an intrusion, because an intruder may carefully cut through the connecting members placed at the joints between optical fibers, along a plane substantially parallel to the plane of the fence, and thus free the optical wires from the mutual, rigid connection on which the operation of the fence depends; and it is sensitive to false alarms caused e.g. by animals pushing against the fence.

Prior U.S. Pat. No. 4,399,430 - Kitchen - relates to a security fence intended for the same purpose and which also includes optical fibers, means for transmitting light through these and means for detecting a change of light intensity due to mechanical forces applied to the fence structure. The Kitchen structure is a woven structure, defined by a Textile Dictionary as "a structure composed of two interlaced materials in the warp and weft directions" (In Kitchen: "elongated members"). Woven structures require the interlacings of two components: warp and weft, with a plurality of strands in each direction.

Contrary to common woven textile products, the spacings between the strands in Kitchen's Patent are large, not jammed next to each other and therefore are not fixed in space, which makes it possible to move the strands of the warp and the weft in the direction of the application of force.

Kitchen inserts ferrules, which can be encapsulated, at the intersections so that they prevent a movement of the strands. This is imperative for the Kitchen fence as otherwise such a fence is easily penetrated.

Scrutiny of Kitchen's Patent reveals a serious flaw: his FIGS. 1, 2, 3, 3*a* and 4 describe such a woven structure, whereas Kitchen's FIGS. 5, 6 and 6*a* are not related to the woven structure, and no teaching is provided how such joining points can be produced in a woven structure. According to expert opinion, the joining points of his FIGS. 5, 6 and 6*a* are feasible in a woven structure. Kitchen comments on the superiority of such joinings but does not demonstrate how these can be produced. It seems that these are inoperable and were included in an attempt to cover all possibilities. It is not possible to produce Kitchen's woven structure from a single strand. This is an inherent feature of his structure.

A structure with such "interweaving" joints as shown in said patent, can be produced by either weaving or by unique braiding.

When such a structure is produced by weaving it will require two systems of strands, called warp and weft, with multiple intersecting strands in each. A woven structure used for the purpose of constructing a security fence with optical wires, will require a multitude of Transmitter/receiver units.

When the said structure is produced by braiding it will require only one warpwise system of strands which will be used for the warp, but also for the weft. As the structure is mounted on a frame in a diagonal configuration, each strand reaches the edge of the structure, interlaces around the frame and changes direction, to create the weft. Each strand is used in a "serpentine" manner, and appears again and again in different sections of the structure. The number of strands needed to produce the braided structure depend on the width of the structure (used as the height of the fence), and the wider the fence needed the more numerous the number of strands, and also the number of transmitter/receiver units needed. In order to prevent intruder penetration, the intersections must be strengthened by rigid elements, such as ferrules.

Another drawback of the known security fences based on optical fibers, is that they will not respond to sound an alarm unless the fibers have been cut or deformed to a degree which requires that a very high load be placed on them. If the fiber is not cut but deformed, the transmission of light therethrough will not completely cease, but will be reduced; however, a reduction sufficient to cause the system to respond will only be produced beyond a high deformation threshold. For this reason it has been suggested in the prior art, to provide the fence with auxiliary devices, such as the rigid joints of the cited European Patent, which will cause damage to the fiber and sharply reduce the light transmission through them. However, the need for such auxiliary devices is a drawback, and further, they can be cut and neutralized.

OBJECTS OF THE INVENTION

It is an object of the invention to provide a security fence, which serves as an intrusion detection barrier, which will be free of the drawbacks of the barriers of the prior art, and specifically, will provide security against any attempt either to pass over it or to cut through it.

It is another object of the invention to provide such a security fence which includes per fence section only one weft-knitted optical fiber, one optical transmitter and one receiver, and is therefore simpler and more economical than the previously known ones.

It is a still further object of the invention to provide such a fence which causes an alarm to be given whenever it is cut at any place thereof. It is a still further object of the invention to provide such a fence that is extremely simple from the structural viewpoint both as to the optical elements which are comprised in it and to the other elements and devices required for its installation and operation. The weft knitted netting is self supporting and in the interlooped structure the loops maintain their geometric shape, and do not require reinforcing elements.

Other purposes of the invention will appear as the description proceeds.

SUMMARY OF THE INVENTION

The invention provides a security fence which is characterized in that it comprises in each fence section a single weft knitted optical wire structure mounted under tension between upper and lower tension wires. Preferably at least one of said upper and lower tension wires is, or, more preferably both of them are, optical wires. By "optical wires" is meant in this description and in the claims, wires which comprise or are made of optical fibers, which provide a channel for light transmission, provided with a protective coating or with a sheath. The optical wires, forming the active components of the optical security fence, are connected to light transmitters and light receivers and these in turn are connected, through control devices, to alarm systems, whereby interruption or reduction below a certain threshold of the light transmission through an optical wire is sensed by a light receiver and results in an alarm being given, the netting of each section being weft knitted from a single optical fiber. Said light transmitters and light receivers, control devices and alarm systems and their structural and functional connections are conventional elements, present in existing optical security fences, so that they need not be described.

The weft knitted optical wire structure may have any desired length and width and is made of a single optical fiber per fence section, as is known in the weft knitting art. If the fiber is cut or damaged, the light transmission is interrupted or sharply reduced and an alarm is activated.

DETAILED DESCRIPTION OF PREFERRED EMBODIMENTS

Figure 1:
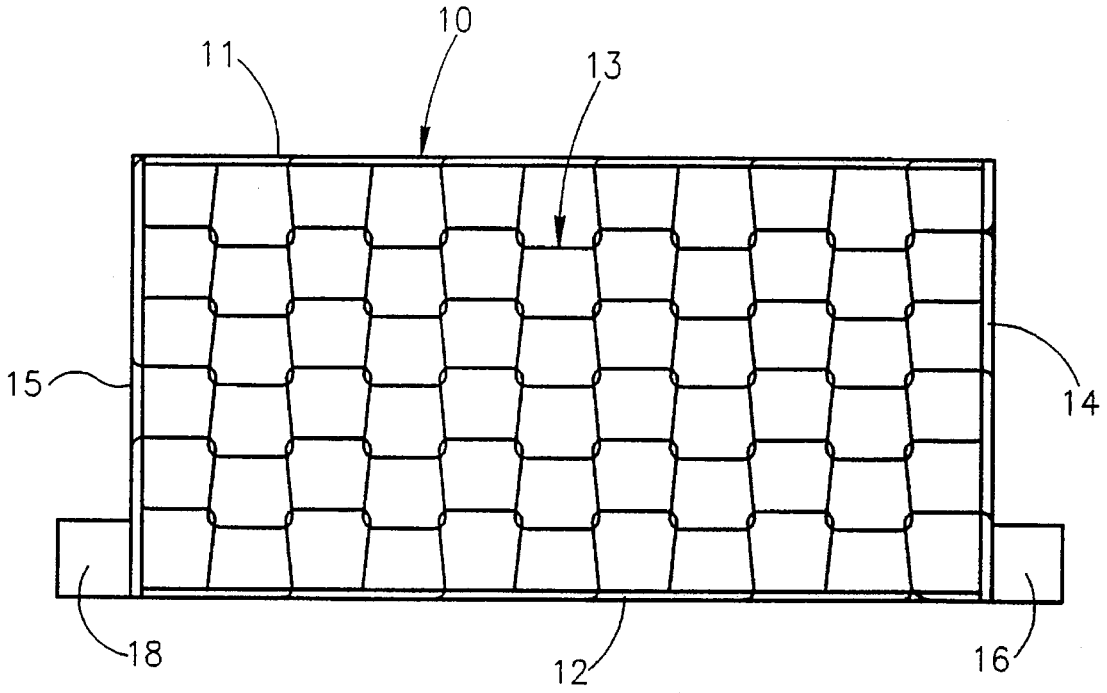
FIG. 1 is a schematic front view of a segment of a security fence according to an embodiment of the invention.

With reference to FIG. 1, numeral 10 generally indicates a section of a security fence according to the invention, which can be of any desired dimensions. The section of the fence comprises an upper tension wire 11 and a lower tension wire 12 which, in this embodiment, are also optical wires 14 and 15 indicate two posts which, together with the tension wires 11 and 12, constitute a parallelogram which forms the frame for a single weft knitted, interlooped optical wire structure 13, to which said structure is connected under tension in both the vertical and the horizontal direction. Control boxes 16 and 18 contain all the necessary auxiliary equipment, which is conventional per se, including light transmitters, light receivers and a control device for the alarm system. Each optical wire component is associated with a light transmitter and a light receiver, with which it constitutes an optical circuit. Thus the control boxes 16 and 18 will contain light transmitters and receivers for the tension wires 11 and 12, and for the single wire which constitutes the knitted structure 13.

Figure 2:
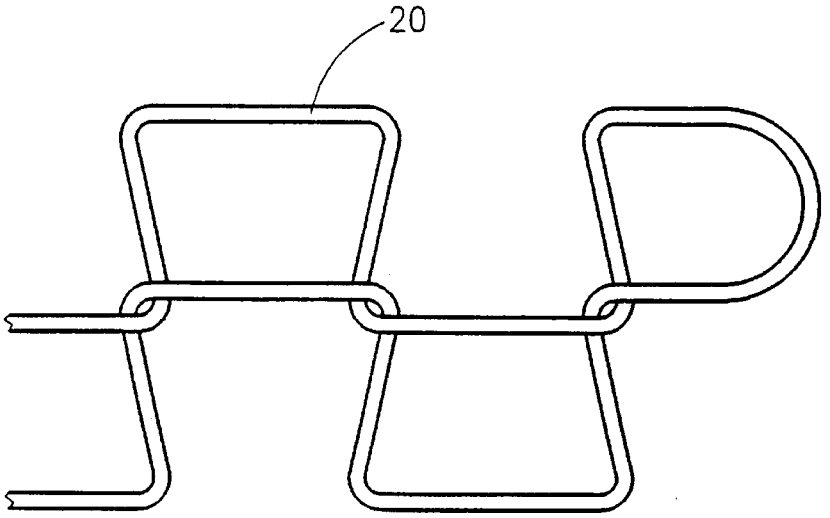
FIG. 2 is a schematic view of a fragment of a weft knitted structure, according to an embodiment of the invention, which structure, for purposes of illustration, is shown in a relatively loose condition and not under tension as it would be when in use.

The weft knitted structure 13 may be of any type that is known in the weftknitted art. In FIG. 2 a portion of a weft-knit structure, conventional per se, is shown, which is composed of a single wire 20.

According to another aspect of the invention, a novel optical wire structure is provided which is more sensitive to loads than the optical wires of the prior art. This novel wire is intended to be used in a straight, taut configuration, particularly as the upper tension wire in a fence such as illustrated in FIG. 1, but also as a tension wire, isolated or not, in any security installation, to react and activate an alarm not only when it is cut, but also whenever an intruder attempts to climb over it.

Figure 3A:
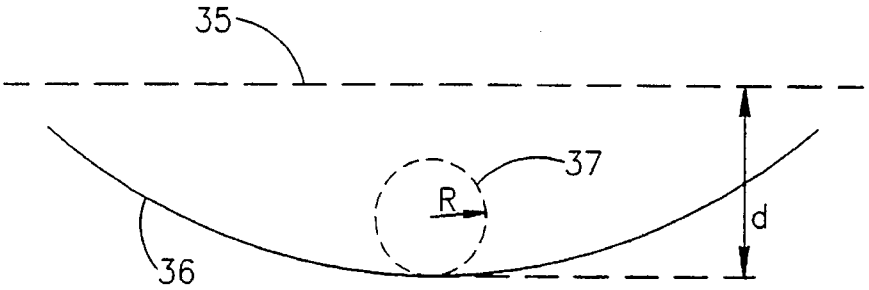
FIG.3A PRIOR ART
FIGS. 3*a* and 3*b* illustrate the comparative behaviour of a conventional optical wire and a wire according to an aspect of the invention.

FIGS. 3*a* illustrates the behaviour of said novel optical wire. In FIG. 3*a*, a conventional wire is shown, which is intended to be in the straight configuration, illustrated by the broken line 35, e.g. when it is used as upper tension wire in fence of weft woven optical wires. An attempt to climb over such a wire will give rise to a vertical load or to a load having a vertical component, and the wire will bend as indicated in FIG. 3*a* and will assume the configuration 36 illustrated in a full line. It is seen that the deflection of the wire is that indicated by "d" and constitutes a measure of the load placed thereon. When the deflected optical wire has assumed the curved configuration 36, it will have a curvature that is ordinarily at a maximum at the point of greatest deflection. The radius of curvature will be "R", and will be the radius of the circle shown in broken line at 37 in FIG. 3*a*. Bending of an optical fiber results in reducing light transmission, but before a system comprising the fiber can react in any way, and in particular, before an alarm can be given, the said reduction must reach a certain threshold, which corresponds to a certain radius of curvature, which can be called the maximum reactive radius. Let us assume that the maximum reactive radius is smaller than the radius "R" of circle 37: if so, the reduction of the light transmission through the bent optical fiber 36 will not be large enough for the system to react, and no alarm will be given.

Figure 4:
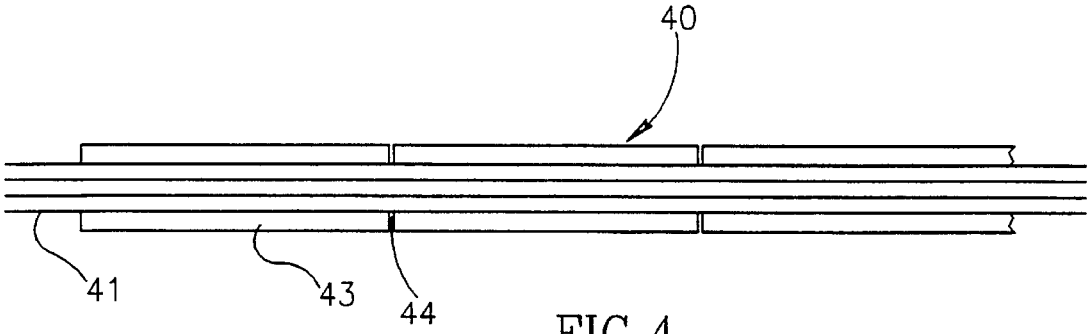
FIG. 4 illustrates an optical wire according to an embodiment of the invention.

Now, according to an aspect of the invention, the optical wire is provided with a succession of segmental coverings or sheaths, as illustrated in FIG. 4. In this latter, numeral 40 generally indicates the optical wire according to this embodiment of the invention. This comprises optical fibers 41 and segmental sheaths 43, arranged in longitudinal succession about the optical fibers. The segments are preferably in mutually abutting relationship, but small intervals could be left between them, if desired, as shown at 44 in the drawing. The segmental sheaths are made of a relatively rigid material, viz. material that is substantially rigid with respect to the optical fibers and which can be of any kind, but is conveniently a plastic or metal. Preferably the length of the segments is between 6 and 20 cm, the diameter thereof is between 4 and 15 mm. In order to increase the sensitivity of the system, it is desirable to use an optical fiber component the length of which is a multiple of the length of the optical wire. This may be done by using a plurality of optical fibres 41, optically connected in any suitable way at the ends of the wire, e.g. in correspondence of the posts between which the fence is disposed, to form a continuous optical path for the transmission of light therethrough. Alternatively, one may use a single, continuous optical fibre, bent back at the ends of the wire to form a number of parallel branches along the length of the wire (in which case numeral 41 designates each of said branches), care being taken that the radius of the bent portions be greater than the maximum reactive radius hereinbefore defined. Since all the fibres, or fibre branches, extend in parallel relation along the wire, they will all be bent by the same angle and similarly stretched when the wire is bent. A reduction of the light transmission will occur in each fibre or branch at the bent and stretched zone and an overall reduction, that is a multiple of the reduction occurring in each fibre or branch, will thus be produced. In this way the sensitivity of the system will be greatly increased.

Figure 3B:
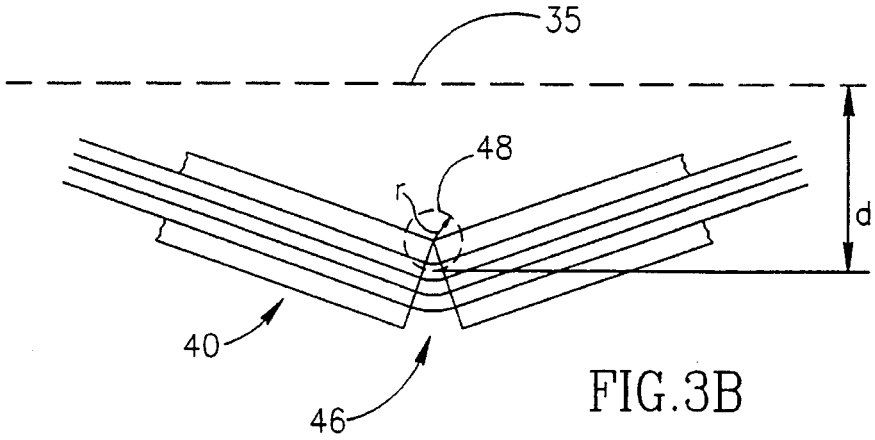

The behaviour of the optical wire according to the invention is illustrated in FIG. 3*b*. The initial, straight position thereon is once again indicated in broken lines by numeral 35 and the wire is generally indicated in its deflected position at 40. It will be seen that the deflection of the wire is the same as in FIG. 3*a* and therefore the load applied to the wire will substantially be the same. However, according to the invention the optical wire will not bend at all in correspondence to the sheath segments. These will rotate, as shown in the drawing, so that their edges which are on the side of the concavity of the bent wire—generally the upper edges, as in the drawing—will remain in contact and their opposite edges will draw away from one another. Consequently, the optical fibre will be stretched in the zones in which the edges of any two adjacent segments are no longer in contact and will also bend in said zones, as shown at 46 in FIG. 3*b*. The radius of curvature "r" of the optical fibers under those conditions will be the radius of the circle 48, and it is seen that, the deflection being equal, "r" is much smaller than "R". Consequently, while "R" may be larger than the maximum reactive radius, "r" may be smaller, and thus the wire according to the invention will cause the security system to react while a conventional optical wire would not do so. Additionally, the optical fibres are stretched at 46, and this deformation also affects the light transmission, whereby the reactivity of the system is further increased.

In a preferred embodiment of the invention, the security fence comprises an optical wire according to the embodiment of FIG. 4 as upper tension wire, which guards against intrusion by climbing over the fence, while the knitted structure and the lower tension wire are made of ordinary optical fiber structures, which can be relied upon to react to complete interruption of the light transmission, viz. to cutting. Complete safety and high sensitivity are thus achieved at a minimal cost.

Whereas the weft knitted optical wire structure is stated to be mounted under tension between upper and lower tension wires, it is to be understood that the knitted optical wire structure can be tensioned between tension wires which are in a vertical position or at any desired angle.

While certain embodiments of the invention have been described by way of illustration, it will be understood that the invention can be carried into practice by skilled persons with many modifications, variations and adaptations and by the use of equivalent means, without departing from its spirit and from the scope of the claims.

I claim:

1. A security fence which comprises at least one section of fence, wherein said at least one section of fence consists essentially of a single weft-knitted interlooped optical wire and a frame, said frame having two upright posts, an upper tension wire spanning the distance between said upright posts, and a lower tension wire spanning the distance between said upright posts, said upright posts and tension wires being arranged so as to define a parallelogram, said single weft-knitted interlooped optical wire being connected to said frame by being looped around said posts and said tension wires, said single weft-knitted interlooped optical wire being under tension in both the vertical and horizontal directions so as to maintain the geometrical configuration without any auxiliary means, one end of said single weft-knitted interlooped optical wire being connected to a light transmitter, and the other end of said single weft-knitted interlooped optical wire being connected to a light receiver, which light receiver is connected to an alarm so that an abrupt change in the intensity of light passing through the single weft-knitted interlooped optical wire actuates said alarm.

2. Security fence according to claim 1, wherein at least one of said upper and lower tension wires is an optical wire.

* * * * *